United States Patent [19]

Bogataj

[11] Patent Number: 5,029,425

[45] Date of Patent: Jul. 9, 1991

[54] STONE CLADDING SYSTEM FOR WALLS

[76] Inventor: Ciril Bogataj, 9481 Ravenna Rd., Twinsburg, Ohio 44087

[21] Appl. No.: 322,699

[22] Filed: Mar. 13, 1989

[51] Int. Cl.[5] ..... E04B 1/38; E04F 13/08

[52] U.S. Cl. ..... 52/482; 52/478; 52/510; 52/551; 52/715; 52/735

[58] Field of Search ..... 52/551, 510, 235, 387, 52/508, 550, 478, 482, 732, 541, 386, 712, 715, 735

[56] References Cited

U.S. PATENT DOCUMENTS

| | | | |
|---|---|---|---|
| 2,642,968 | 6/1953 | Roush et al. | 189/86 |
| 4,134,244 | 1/1979 | Sjölander | 52/550 X |
| 4,262,464 | 4/1981 | Ludowici | 52/510 |
| 4,803,821 | 2/1989 | Funaki | 52/551 X |
| 4,856,245 | 8/1989 | Osawa | 52/510 |

OTHER PUBLICATIONS

4-Page Brochure Bearing the Legend "COLOROC".

*Primary Examiner*—Michael Safavi

*Attorney, Agent, or Firm*—Pearne, Gordon, McCoy & Granger

[57] ABSTRACT

A stone cladded system for walls, including metal battens mounted in arrays of vertically extending, laterally spaced battens on a supporting wall structure of a building. Stonelike cladding members extruded or molded from cementious material are mounted on the battens and provide an exterior wall surface for a building. The battens provide upwardly facing, hook-shaped support projections which extend into downwardly open grooves in the cladding members to support the cladding members on the battens. Bendable locking tabs are provided on the battens which are bent out over the upper edges of the associated cladding members to lock the cladding members in position in engagement with the hook-shaped support projections.

10 Claims, 2 Drawing Sheets

STONE CLADDING SYSTEM FOR WALLS

BACKGROUND OF THE INVENTION

This invention relates generally to building wall structures, and more particularly to a novel and improved stone cladding system in which stonelike veneer is mounted on a wall with metal battens.

PRIOR ART

It is known to provide a stonelike veneer or cladding system on existing and new buildings by mounting metal battens on the supporting wall and mounting cementious, stonelike veneer strips on the battens. Such battens have been formed with hook-shaped support projections which fit into downwardly opening mating grooves formed in the veneer strips. In such systems, the veneer strips and the battens are structured so that the strips can be mounted along the bottom of the wall and progressively installed in an overlapping manner up along the wall surface.

In such system, the weight of the veneer strips is relied upon to maintain the interlocking of the support projections of the battens with the mating grooves in the veneer strips. Since such veneer strips are cast or extruded from sand and cement, they are relatively heavy and tend to remain in their installed position. However, in some instances, a mechanical interlocking mounting which positively locks the veneer strips in position is very desirable or required.

It is also disclosed in U.S. Pat. No. 2,642,968 to secure metal siding panels on metal battens and to provide locking tabs to hold the panels against a support projection.

SUMMARY OF THE INVENTION

The present invention provides a novel and improved stone cladding system for the walls of buildings. In such system, cladding members or veneer strips are mounted on metal battens and are mechanically locked in their installed position.

In the illustrated embodiment, vertically extending sheet metal battens are mounted on the building support wall in parallel arrays. The battens are generally U-shaped, providing similar laterally spaced legs extending to support edges against which the cladding members are mounted. The battens provide hook-shaped support projections which extend forwardly from the mounting edges and up into a mating groove formed in the cladding members. Locking tabs also extend from the support edges and engage the upper edges of the cladding members to lock them in a mounted position.

The illustrated veneer strips or cladding members are stonelike, cementitious material which is molded or extruded to the required shape. The illustrated cladding members provide offset, upper and lower planar portions which are centrally joined. A downwardly opened groove is provided at the lower edge of the upper planar portion. When installed, this groove fits down over the batten support projections and the upper planar portions are positioned against associated support edges on the battens. Because of the offset, the lower planar portion is spaced out from the support edges of the battens and projects down along the outer face of the adjacent lower cladding member. Therefore, the cladding members cooperate to provide a fully integrated exterior wall surface. The locking tabs are bent out over the upper edge of each cladding member as they are installed. Therefore, a positive mechanical connection is provided to secure each cladding member in its mounted position.

The support projections and locking tabs are sized and located so that the material requirement to produce the battens is not increased by the provision of the locking tabs.

These and other aspects of this invention are illustrated in the accompanying drawings, and are more fully described in the following specification.

DETAILED DESCRIPTION OF THE PREFERRED EMBODIMENT

Figure 1:
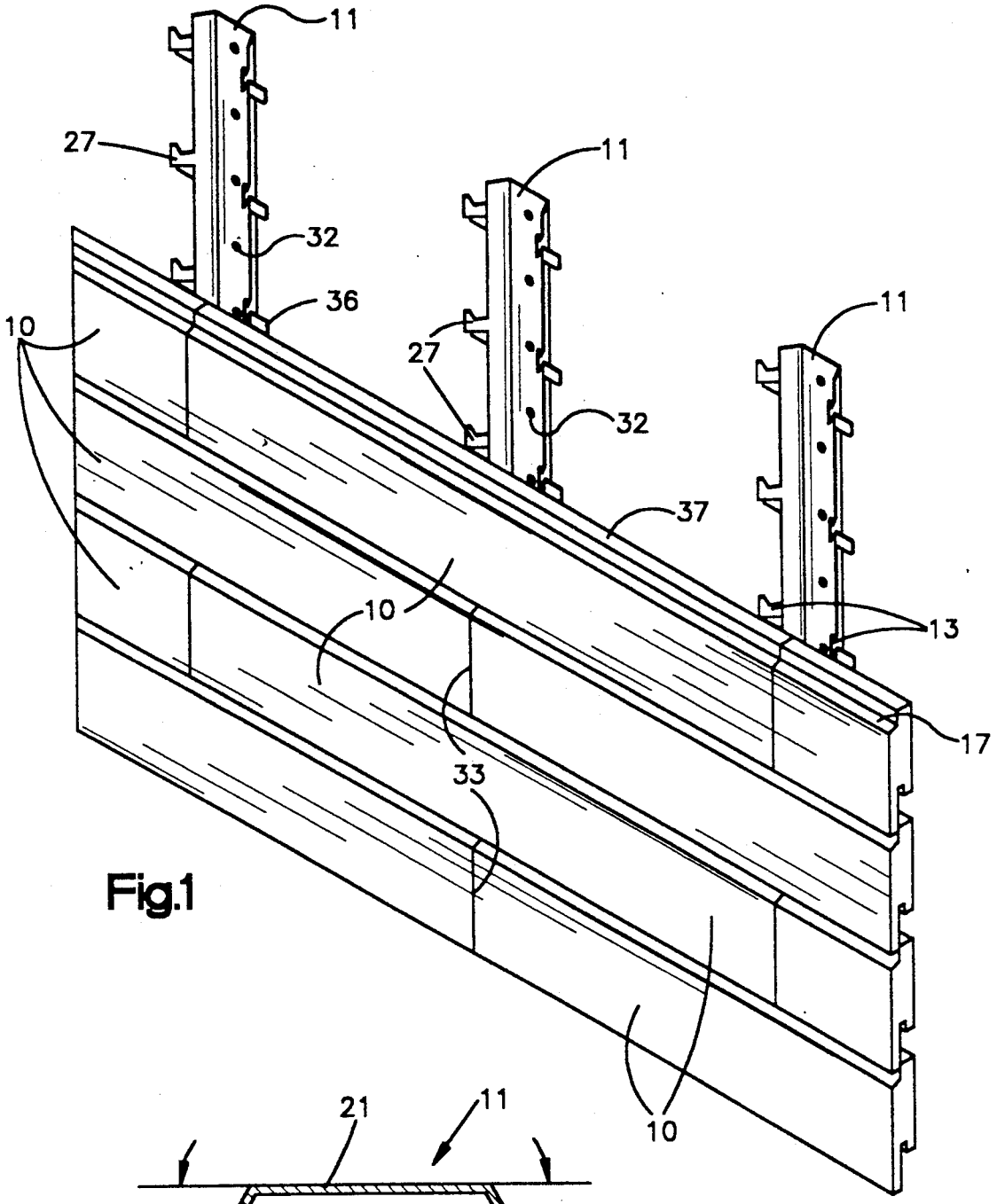
FIG. 1 is a perspective view of a portion of a wall structure incorporating the present invention.
Figure 3:
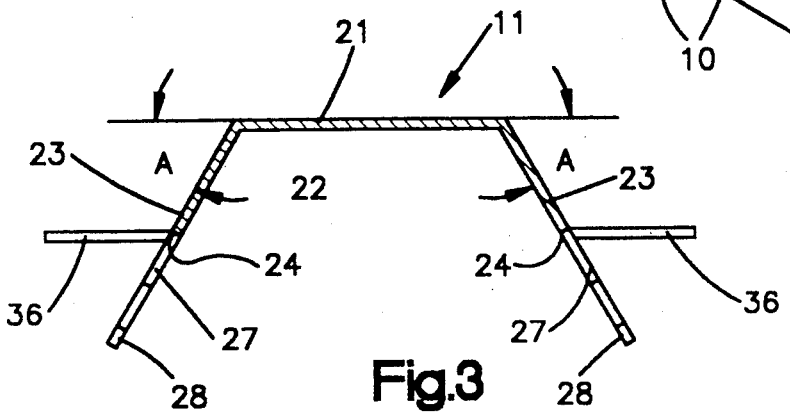
FIG. 3 is a cross section of one of the metal battens.
Figure 2:
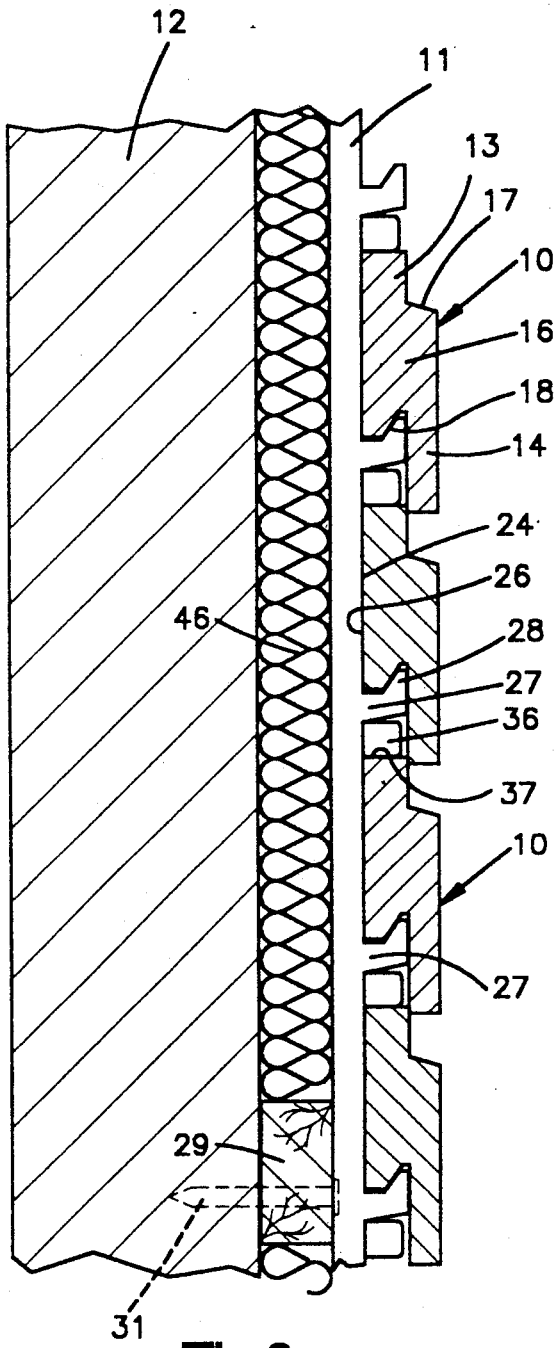
FIG. 2 is a vertical cross section illustrating the structural detail of a cladding system in accordance with the present invention mounted on a wall.

FIGS. 1 and 2 best illustrate the shape of the cladding members 10 which are supported by an array of battens 11 to provide the exterior surface of a support wall, schematically illustrated at 12. Each of the cladding members includes an upper planar portion 13 and an outwardly offset planar portion 14. The two planar portions overlap and are joined on a central portion 16. The upper end 17 of the offset portion 14 is preferably inclined upwardly and inwardly so that moisture will pass smoothly down the wall. At the lower edge of the upper planar portion, the cladding members 10 are provided with a downwardly open, generally V-shaped notch 18. The cladding members 10 are formed by molding or extrusion of a cementitious material which gives a stonelike appearance. For example, the cladding members can be extruded from a mixture of sand and cement to which a protective surface seal of acrylic material is applied.

The battens 11 are preferably formed of sheet aluminum or other non-corrosive sheet metal. The battens have a generally U-shaped cross section and provide a planar base portion 21 and forwardly extending legs 22 and 23. Such legs 22 and 23 are preferably positioned to diverge from the plane of the base portion 21 by an angle A of about 60 degrees. Each of the legs extends forwardly to a support edge 24 against which the inner face 26 of the upper planar portion 13 is positioned.

Extending forwardly from the support edges 24 of each of the legs 22 and 23 are vertically spaced, hook-shaped support projections 27. Each of the support projections 27 is provided with an upwardly extending V-shaped end portion 28 which is sized to project up into and mate with the V-shaped recesses 18 in the cladding members. Therefore, the support projections support the associated cladding members 10 with the inner faces 26 thereof against the support edges 24.

The battens 10 are secured to the support wall 12 of the building against horizontally extending furring strips 29. Typically, fasteners 31 are driven through openings 32 in the base portion 21 to mount the battens on the support wall 12. Such fasteners may be, for example, lag screws or the like. Further, if desired, metal brackets which are mounted on the support wall 12 may be used to support the battens.

The battens are first installed on the wall in an array of vertically extending, horizontally spaced battens. The cladding members are then positioned on the battens in an overlapping relationship. Initially, the lower cladding members are installed and then progressively higher cladding members are installed along the battens. When installed, the outwardly offset planar portion of the cladding members extends down in an overlapping relationship along the upper portion of the upper planar portion 13 to provide an uninterrupted wall structure. The abutting ends 33 of each course of cladding members are positioned so that they are in alignment with the center of the adjacent batten. Consequently, one leg 22 supports the end of one abutting cladding member, and the other leg 23 supports the end 33 of the adjacent abutting cladding member.

In order to ensure that the cladding members are positively locked to the associated battens, the battens are provided with locking tabs 36 immediately below an adjacent support projection 27. These locking tabs are bent forward over the upper end 37 of an upper planar portion 13 to prevent the associated cladding members from raising up off the associated supporting projection. In some jurisdictions, it is required that the cladding members be secured in position in a positive mechanical manner and the locking tabs 36 meet such requirement.

In order to provide the space required for the locking tabs 36, the cladding members are proportioned so that the width of the upper planar portions 13 is less than the spacing between the support projections 27 by an amount at least equal to the width of the locking projections. Therefore, the upper edges 37 of the upper planar portions 13 are spaced below the next support projection by a distance at least equal to the height of the locking tab 36.

Figure 4:
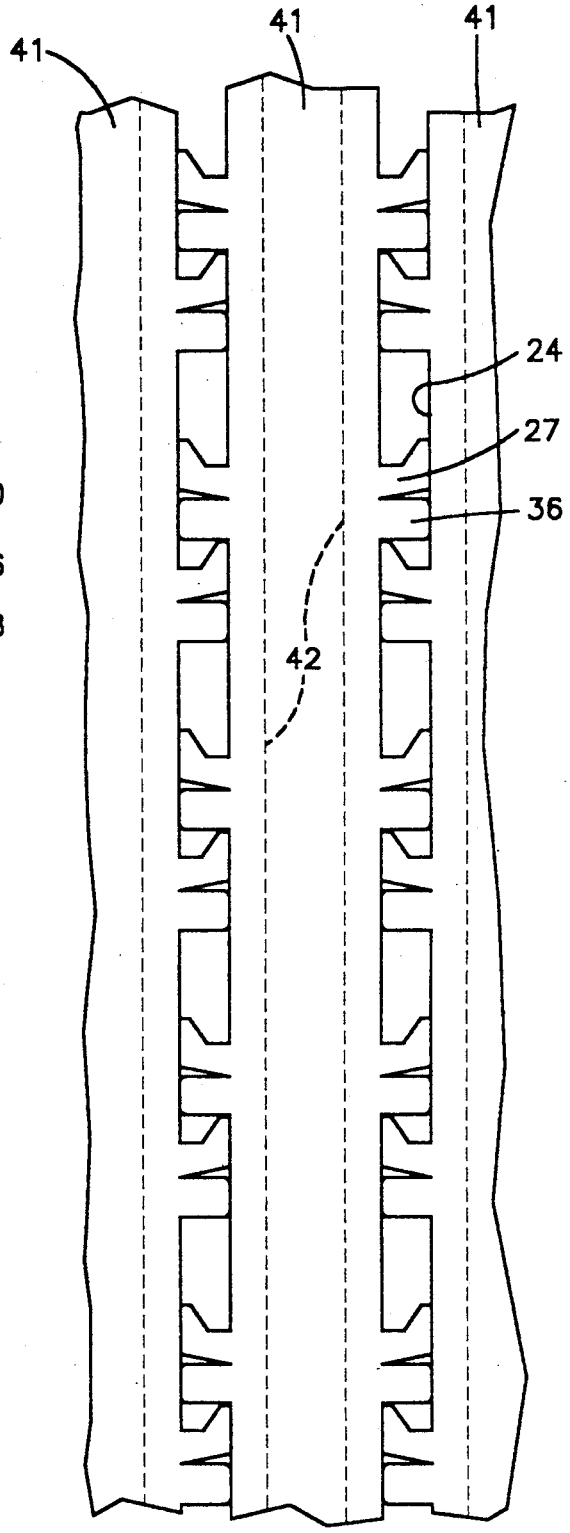
FIG. 4 is a fragmentary view illustrating a preferred method of forming the blank for the battens with a minimum of scrap.

As best illustrated in FIG. 4, the provision of the locking tab 36 does not increase the material requirement for producing the battens 10. Preferably, the blanks 41 for the battens 11 are sheared from a sheet of corrosion-resistant metal, such as aluminum. Each of the blanks is located with respect to the sheet so that the ends of the support projections 27 and locking tabs 36 on one blank extend along the support edge 24 of the adjacent blank. Further, since the spacing between the adjacent support projections 27 is greater than the height of the support projections 27 and twice the height of the locking tabs 36, the overlapping arrangement of the blank 41 can be provided. The provision of the locking tabs merely reduces the amount of scrap which would otherwise be produced when the blanks 41 without such tabs were cut from a single sheet of metal. The tabs 36 can be seen having an upper edge merging with an edge of the upper adjacent support projections 27.

After the blanks 41 are cut, the legs 22 and 23 are formed by bending the blanks along the bend line indicated by the dotted lines 42. Also, the locking tabs 36 are bent back to a position substantially parallel to the base portion 21 so that they do not interfere with the installation of the cladding members 10. Once the cladding members are installed, the locking tabs are bent forward over the upper ends 37 of the cladding members to securely lock them in their mounted position on the battens.

The overlapping relationship of each cladding member with the next-above and the next-below cladding member prevents the cladding members from rotating along their length relative to the hook-shaped projection. Therefore, the upper ends 37 cannot pivot out from under the associated locking tab 36 and a positive mechanical lock is provided with a simple, bendable tab.

With this invention, insulation may be installed on the support wall behind the battens 11. Because the battens space the cladding members from the wall 12 and insulation, an air space is provided behind the cladding members to ensure that the wall is adequately vented. This prevents the collection of moisture within the wall.

Although the preferred embodiment of this invention has been shown and described, it should be understood that various modifications and rearrangements of the parts may be resorted to without departing from the scope of the invention as disclosed and claimed herein.

What is claimed is:

1. A cladded wall structure comprising a support wall, a plurality of vertically extending battens mounted on said support wall, and a plurality of cladding members supported on said battens cooperating to provide an external wall surface, said battens providing a generally planar base portion adapted to be mounted on said support wall and vertically spaced support projections extending in a direction away from said support wall and providing upstanding ends, said cladding members each providing a generally planar first portion positioned against said battens and an outwardly offset second portion outwardly spaced from said battens, said cladding members also providing a downwardly open groove spaced substantially from an upper edge of said first portion fitting over said upstanding ends to support said cladding members and hold said first portion against said battens, said second portions of said cladding members overlying the upper edges of the next adjacent lower cladding member, said upper edge of each cladding member being spaced below the above adjacent support projection, said battens providing locking tabs between the above adjacent support projections and the adjacent upper edges of the next adjacent lower cladding members, said locking tabs having a bend line that is spaced substantially from the plane of said planar base portion whereby said tabs may be gripped for bending into locking relationship with a cladding member without close interference with the base portion or wall surface, said locking tabs in said locking relationship extending over said adjacent upper edges to prevent upward movement of said cladding members and cooperating with said support projections to lock said cladding members and battens together, said locking tabs avoiding interference with the installation or removal of the next adjacent upper cladding members.

2. A cladded wall section as set forth in claim 1, wherein said battens provide laterally spaced similar legs each providing support projections and locking tabs, at least some of said cladding members providing abutting ends positioned between said legs so that each adjacent abutting end is supported by one leg of an associated batten.

3. A cladded wall structure as set forth in claim 2, wherein said locking tabs are bent forward over said cladding members after said cladding members are positioned against said battens, said upper adjacent support projection having a base that is spaced substantially from the plane of said planar base portion, said bend line of said locking tabs being located near the base of said upper adjacent support projection.

4. A cladded wall structure as set forth in claim 3, wherein the spacing between adjacent support projections exceeds the width of said projections plus two times the width of said locking tabs.

5. A cladded wall structure as set forth in claim 4, wherein the spacing between adjacent support projections exceeds the width of said planar first portion.

6. A cladded wall structure as set forth in claim 1, wherein said cladding members overlap with the next-above and next-below cladding member, said overlapping relationship preventing said upper edges of said first portion from rotating out from under associated locking tabs.

7. A sheet metal batten for mounting cladding members comprising an elongated planar base portion adapted to be mounted on a support wall, a forward extending leg joined to each side of said base portion, said legs for each course of cladding members providing a pair of hook-shaped support projections having outstanding ends structured to fit into downwardly open grooves in said cladding members to secure said cladding members to said battens, said legs also including pairs of locking tabs for each course of cladding members adapted to engage the upper edges of associated cladding members to hold said grooves down on said upstanding ends and mechanically lock said cladding members on said battens, said locking tabs having a bend line that is spaced substantially from the plane of the base portion whereby said tab may be gripped for bending without close interference with said base portion or wall surface with an edge of the locking tabs merging with an adjacent edge of an upper adjacent support projection.

8. A sheet metal batten as set forth in claim 7, wherein adjacent support projections are spaced by a distance greater than the width of said support projections plus two times the width of said locking tabs.

9. A sheet metal batten as set forth in claim 8, wherein said support projections have a length at least as great as the length of said locking tabs, said locking tabs having a bend line located near the base of an upper adjacent support projection.

10. A sheet metal batten as set forth in claim 9, wherein said legs diverge as they extend from said base portion.

* * * * *